US007038575B1

(12) United States Patent
Frohman et al.

(10) Patent No.: US 7,038,575 B1
(45) Date of Patent: May 2, 2006

(54) SOUND GENERATING APPARATUS FOR USE WITH GLOVES AND SIMILAR ARTICLES

(75) Inventors: Jan A. Frohman, Lincoln, NE (US); James L. Jorgensen, Albuquerque, NM (US)

(73) Assignee: The Board of Regents of the University of Nebraska, Lincoln, NE (US)

( * ) Notice: Subject to any disclaimer, the term of this patent is extended or adjusted under 35 U.S.C. 154(b) by 54 days.

(21) Appl. No.: 09/871,016

(22) Filed: May 31, 2001

(51) Int. Cl.
*G08B 3/10* (2006.01)

(52) U.S. Cl. ..... 340/384.7; 340/384.3; 340/691.2

(58) Field of Classification Search ..... 340/384.7, 340/574, 693.5, 691.2, 384.3; 446/397, 418, 446/297
See application file for complete search history.

(56) References Cited

U.S. PATENT DOCUMENTS 4,135,146 A 1/1979 Krupp
4,337,460 A 6/1982 Smith, III et al.
4,587,516 A * 5/1986 Hiraki ..... 340/574 X
4,635,516 A * 1/1987 Giannini ..... 84/600
4,692,748 A * 9/1987 Pinsak et al. ..... 340/573.1
5,005,002 A * 4/1991 Halperin ..... 340/574
5,058,480 A 10/1991 Suzuki et al.
5,177,467 A * 1/1993 Chung-Piao ..... 340/574
5,259,807 A * 11/1993 Crow ..... 446/397
5,580,154 A 12/1996 Coulter et al.
5,629,679 A * 5/1997 Cranford et al. ..... 340/574
5,648,753 A 7/1997 Martin
5,771,492 A * 6/1998 Cozza ..... 2/161.2
6,006,357 A 12/1999 Mead

* cited by examiner

*Primary Examiner*—Thomas Mullen
(74) *Attorney, Agent, or Firm*—Turan P. Odabasi

(57) ABSTRACT

The present invention is directed to a sound generating apparatus, including an article adapted to be worn on a user's hand, and an electronic assembly attached to the article. It further includes structure for generating a sound within the electronic assembly. Still further, it includes an actuator for energizing the electronic assembly to emit the sound.

7 Claims, 3 Drawing Sheets

FIG. 4.
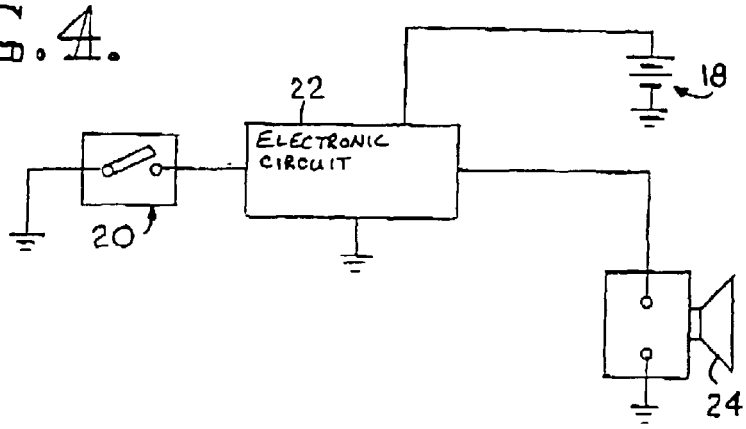
FIG. 5.
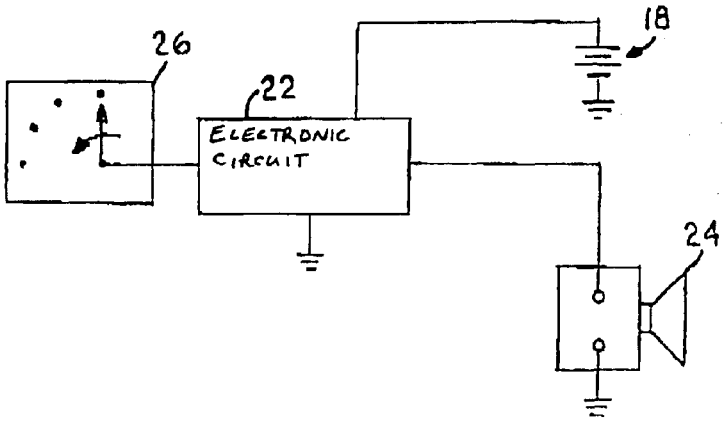
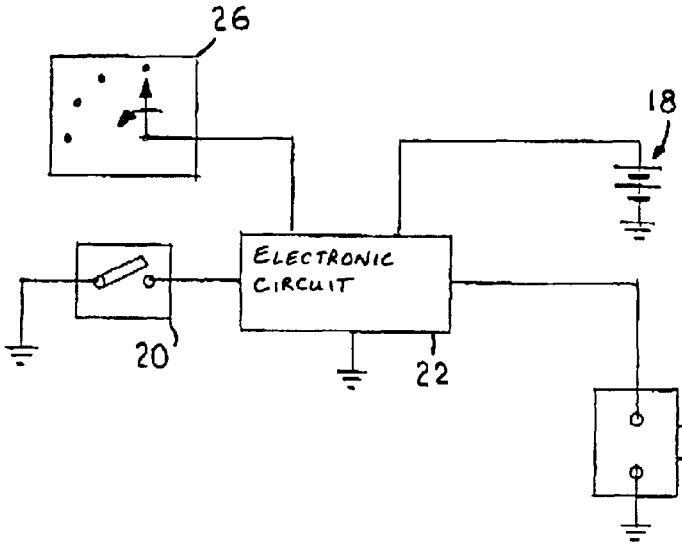
FIG. 6.

SOUND GENERATING APPARATUS FOR USE WITH GLOVES AND SIMILAR ARTICLES

TECHNICAL FIELD

The present invention relates to sound generating devices. More particularly, the present invention relates to sound generating devices to be used in connection with gloves, mittens and related accessories which are designed to produce sports-related sounds, such as applause, cheering and the like.

BACKGROUND OF THE INVENTION

People attend sporting events, such as football or baseball games, to support their favorite teams. Enthusiasm for such events is at an all time high, and such events usually draw large crowds. Part of the allure of attending such events in person involves the active participation of the fan. The louder the fan can cheer for their team, the more connected the fan feels to the game, almost as if the fan was participating in the game. The sound generated by these thousands of fans for their team can give their team a distinct advantage. This is part of what is commonly referred to as the "home field advantage."

When attending outdoor sports events during inclement weather, fans often need to wear gloves or mittens to protect their extremities from the extreme weather conditions and bitter cold. However, the conventional gloves or mittens worn by sports fans have an inherent drawback; the nature of conventional gloves or mittens is such that clapping while wearing such gloves or mittens muffles or completely silences any clapping the sports fans may attempt. Therefore, the following useful and novel article has been developed to allow the wearer of gloves, mittens or the like to generate artificial clapping sounds or other sounds.

SUMMARY OF THE INVENTION

It is an object of the present invention to provide for a sound generating device attached to a glove, mitten or the like. Toward these ends, the present invention comprises a sound generating apparatus comprising an article adapted to be worn on a user's hand; an electronic assembly attached to said article; structure for generating sound within said electronic assembly; and structure for allowing the user to actuate and de-actuate said means for generating sound within said electronic assembly.

It is another object of the present invention to provide a sound generating device for use with a wearer's existing gloves or mittens.

It is yet another object of the present invention to provide a sound generating device for use with a glove, mitten or the like, which can play a variety of sounds.

Additional objects, advantages and novel features of the present invention will be set forth in part in the description which follows, and in part will become apparent to those skilled in the art upon examination of the following, or may be learned from practice of the invention.

DESCRIPTION OF THE DRAWINGS

In the accompanying drawings which form a part of the specification and are to be read in conjunction therewith and in which like reference numerals are used to indicate like parts in the various views.

FIG. 4 is an electrical diagram of an electronic assembly for use in the present invention;

FIG. 5 is an electrical diagram of an alternative embodiment of the electronic assembly;

FIG. 6 is an electrical diagram of another alternative embodiment of the electronic assembly;

DESCRIPTION OF THE INVENTION

Figure 1:
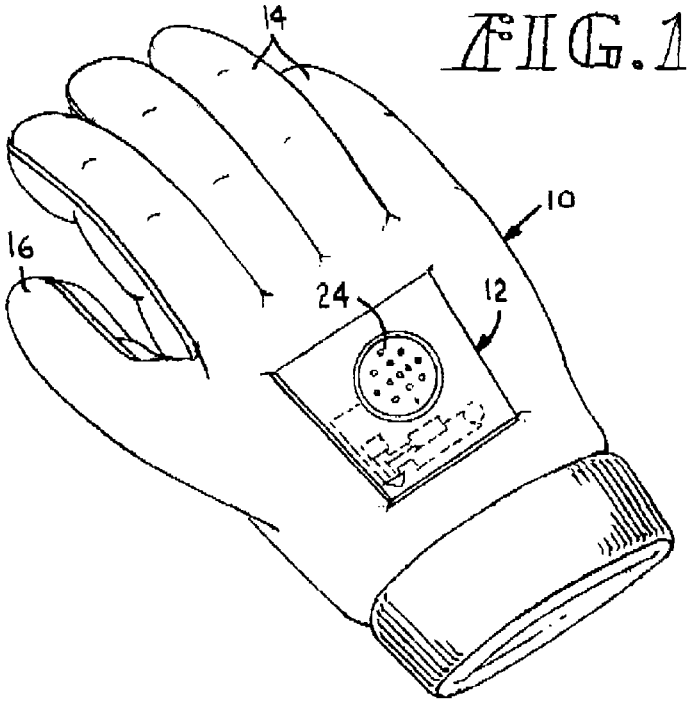
FIG. 1 is an illustration of the present invention.

As shown in FIG. 1, the present invention includes a glove body 10, and a self-contained electronic assembly 12 secured to the glove body 10. The electronic assembly 12 may be secured to the glove body by various methods, including, but not limited to, adhesives, hook and loop closure, stitching, or riveting.

Glove body 10 includes a plurality of finger sheaths 14 and a thumb sheath 16. In the case of mittens, glove body 10 includes a single finger sheath large enough to accommodate four fingers and a thumb.

With reference to FIG. 4, the self-contained electronic sound assembly 12 includes a power source 18, a sensor 20, an electronic circuit 22 for sound storage and driving sound generation, and an audio speaker 24. Power source 18 may be one or a plurality of batteries electrically connected with the sensor 20 and the audio speaker 24, for powering the same. Sensor 20 is electrically connected to power source 18 and electronic circuit 22. Sensor 20 detects that the desired action has occurred; for example, two hands have struck each other with the intent to make a clapping sound. This can be accomplished by a variety of structures, such as a mechanical shock pulse sensor (spring and conductive cylinder), a piezoelectric shock pulse sensor, a surface micro-machined silicon shock pulse sensor, and other shock pulse detecting technologies. An accelerometer, made with a variety of technologies, can be used in place of the shock pulse sensor.

Electronic circuit 22 is electrically connected to sensor 20 and the audio speaker 24. Electronic circuit 22 has stored sounds, such as clapping or other sports-related sounds such as cheering, booing, whistling, and the like. The electronic circuit 22 drives the stored sound pulse or sound sequence into the audio speaker. The construction of electronic circuit 22 is of the type well-known in the art. Audio speaker 24 is electrically connected to, and driven by, electronic circuit 22, and electrically connected to power source 18.

Figure 2:
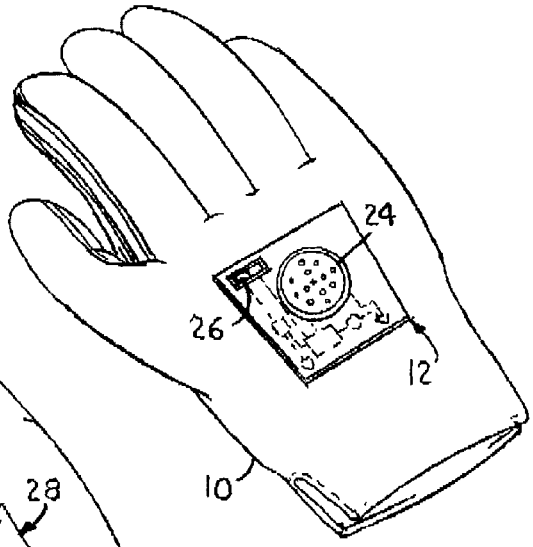
FIG. 2 shows a second embodiment of the present invention.

With reference to FIGS. 2 and 5, in a second embodiment, sensor 20 is replaced with a switch 26 to initiate the sound sequence. Switch 26 allows the user to initiate the sound sequence without performing or simulating the clapping action. Switch 26 may have a plurality of positions; one position would be "off," the other positions would allow the user to determine a specific sports-related sound, such as clapping or cheering. This embodiment allows users to show their appreciation with little physical exertion. This embodiment would benefit users who are frail or have a prosthetic limb as well as users in a crowded venue.

A further alternative electronic assembly 12 is shown in FIG. 6. In particular, this assembly utilizes both a sensor 20 and a switch 26. This circuitry allows a user versatility in selecting sounds, turning the assembly "on" or "off," manually actuating the assembly, and/or utilizing a sensor to actuate the assembly in response to a clapping motion. As is apparent, numerous other variations of assembly 12 are possible utilizing different configurations and some or all of the components of assembly 12.

Figure 3:
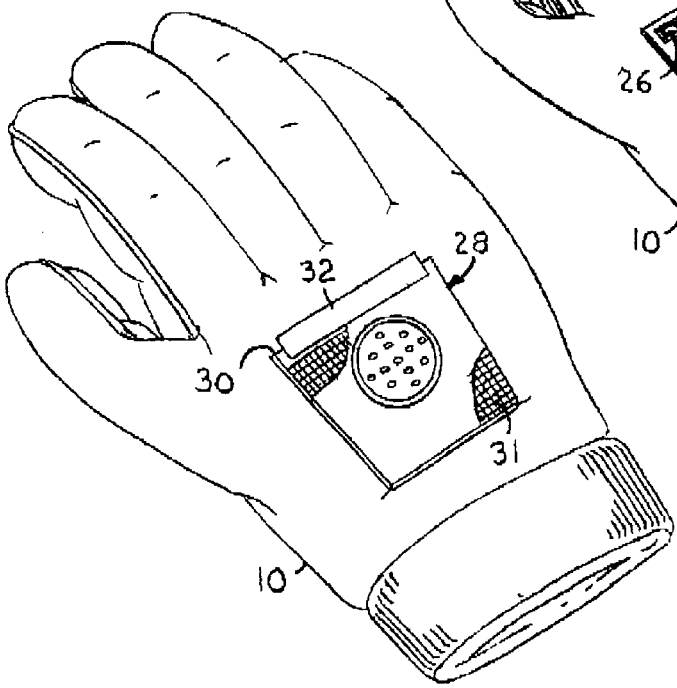
FIG. 3 shows an third embodiment of the present invention.

With reference to FIG. 3, in a third embodiment, a pocket 28 is formed on the glove body. Pocket 28 includes an opening 30 through which self-contained electronic assembly 12 may be inserted and removed. Preferably, the outer layer of the pocket is a mesh material 31 to enable the sound generated by electronic assembly 12 to emanate unhindered from pocket 28. Pocket 28 may include a sealing device, such as a zipper or hook and loop closure 32, to ensure securement of electronic assembly 12 within pocket 28.

Figure 7:
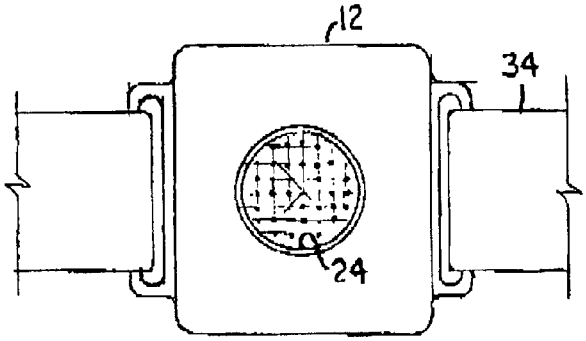
FIG. 7 shows a fourth embodiment of the present invention.
Figure 8:
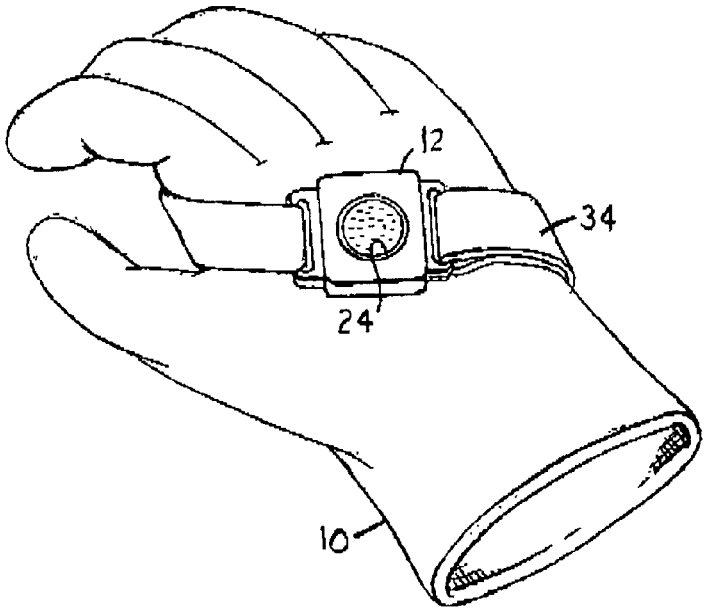
FIG. 8 shows the invention from FIG. 7 in application.

With reference to FIGS. 7 and 8, electronic assembly 12 is secured to strap 34 that may be fastened around the user's hand. This embodiment allows users to enjoy the invention while using existing gloves in their wardrobe or without gloves at all.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A sound generating apparatus comprising:

a protective article worn over and completely covering a user's hand;

an electronic assembly attached to said protective article, said electronic assembly having means for generating sound; and a shock pulse sensor that allows the user to rapidly and repeatedly actuate and de-actuate said means for generating sound by the user clapping his or her hands.

2. A sound generating apparatus comprising:

a protective article worn over and completely covering a user's hand;

an electronic assembly attached to said protective article, said electronic assembly having means for generating sound; and an accelerometer that allows the user to rapidly and repeatedly actuate and de-actuate said means for generating sound by the user clapping his or her hands.

3. A sound generating apparatus comprising:

a protective article worn over and completely covering a user's hand;

an electronic assembly contained within said protective article, said electronic assembly having means for generating sound; and a shock pulse sensor that allows the user to rapidly and repeatedly actuate and de-actuate said means for generating sound by the user clapping his or her hands.

4. A sound generating apparatus comprising:

a protective article worn over and completely covering a user's hand;

an electronic assembly contained within said protective article, said electronic assembly having means for generating sound; and an accelerometer that allows the user to rapidly and repeatedly actuate and de-actuate said means for generating sound by the user clapping his or her hands.

5. A sound generating apparatus comprising:

a protective article worn over and completely covering a user's hand;

an electronic assembly coupled with said protective article, said electronic assembly having means for generating sound; and means for allowing the user to rapidly and repeatedly actuate and de-actuate said means for generating sound, wherein the sounds emitted from the electronic assembly are associated with an athletic event.

6. A sound generating apparatus comprising:

a protective article worn over and completely covering a user's hand;

an electronic assembly coupled with said protective article, said electronic assembly having means for generating sound; and a shock pulse sensor that allows the user to rapidly and repeatedly actuate and de-actuate said means for generating sound by the user clapping his or her hands.

7. A sound generating apparatus comprising:

a protective article worn over and completely covering a user's hand;

an electronic assembly coupled with said protective article, said electronic assembly having means for generating sound; and an accelerometer that allows the user to rapidly and repeatedly actuate and de-actuate said means for generating sound by the user clapping his or her hands.

* * * * *